US006871653B2

(12) United States Patent
Christman et al.

(10) Patent No.: US 6,871,653 B2
(45) Date of Patent: Mar. 29, 2005

(54) METHOD FOR CLEANING AN IN-SINK DISHWASHER

(75) Inventors: Ralph E. Christman, St. Joseph, MI (US); Arnold L. Denne, Stevensville, MI (US); Rud J. Lauer, Hartford, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 13 days.

(21) Appl. No.: 10/826,050

(22) Filed: Apr. 16, 2004

(65) Prior Publication Data

US 2004/0194808 A1 Oct. 7, 2004

Related U.S. Application Data

(62) Division of application No. 10/138,612, filed on May 3, 2002, now Pat. No. 6,742,531.

(51) Int. Cl.[7] ..... B08B 9/08

(52) U.S. Cl. ..... 134/22.1; 134/19; 134/22.18; 134/26; 134/104.1

(58) Field of Search ..... 134/19, 22.1, 22.18, 134/26, 104.1

(56) References Cited

U.S. PATENT DOCUMENTS

| | | | | | |
|---|---|---|---|---|---|
| 3,356,097 | A | | 12/1967 | Schaap | 134/112 |
| 3,456,659 | A | | 7/1969 | Tiby | 134/153 |
| 3,709,236 | A | | 1/1973 | Field et al. | 134/104 |
| 3,961,984 | A | | 6/1976 | Torressen | 134/100 |
| 4,004,600 | A | | 1/1977 | Corn et al. | 134/57 |
| 4,420,005 | A | | 12/1983 | Armstrong | 134/100 |
| 4,465,612 | A | * | 8/1984 | Altenschopfer et al. | 134/22.1 |
| 4,884,585 | A | | 12/1989 | Oh | 134/176 |
| 4,919,162 | A | | 4/1990 | Lumby et al. | 134/115 |
| 5,193,562 | A | | 3/1993 | Rigby et al. | 134/57 |
| 5,579,789 | A | | 12/1996 | Spiegel | 134/104.1 |
| 5,934,298 | A | | 8/1999 | Singh | |
| 6,551,414 | B2 | * | 4/2003 | Reichold | 134/18 |

FOREIGN PATENT DOCUMENTS

| | | |
|---|---|---|
| GB | 929348 | 6/1963 |
| JP | 1297005 | 11/1989 |
| JP | 11137500 | 5/1999 |
| JP | 11169332 | 6/1999 |

* cited by examiner

*Primary Examiner*—Zeinab El-Arini
(74) *Attorney, Agent, or Firm*—John F. Colligan; Robert O. Rice; Stephen D. Krefman

(57) ABSTRACT

A method for cleaning a dish-cleaning appliance having a removable basket that carries a spray arm. The method comprises: uncoupling the liquid supply from the sprayer, spraying liquid against the peripheral side wall from the liquid supply, and draining the sprayed liquid from the wash chamber.

13 Claims, 10 Drawing Sheets

METHOD FOR CLEANING AN IN-SINK DISHWASHER

CROSS-REFERENCE TO RELATED APPLICATION

This application is a divisional of U.S. patent application Ser. No. 10/138,612, filed May 3, 2002, now U.S. Pat. No. 6,742,531; the entire contents of this application are hereby incorporated herein by reference.

BACKGROUND OF THE INVENTION

1. Field of the Invention

The invention relates to a method for cleaning an in-sink dishwasher having a removable basket that carries a spray arm.

2. Description of the Related Art

In-sink dishwashers use the bowl of a sink to form part of the dishwasher housing that defines a wash chamber, with the open top of the bowl providing access to the wash chamber. A liquid recirculation system sprays wash liquid throughout the wash chamber to clean any dishes placed within. A lid covers the open top of the bowl when the in-sink dishwasher is being used to prevent the splashing or spraying of the recirculating wash liquid out of the open top of the bowl.

For the in-sink dishwasher to be convenient for the anticipated user, conversion between the in-sink dishwasher and sink must be easy and simple. Such a convenient appliance will preferably not require the user to couple or uncouple any liquid supply conduits associated with the dishwasher function when switching between the dishwasher function and a traditional sink function. A convenient appliance will also minimize the number of dishwasher components that must be inserted or removed from the sink when switching between the dishwashing and sink functions.

The convenience of the appliance to the user must also be weighed against the complexity and redundancy of components needed to accomplish both the dishwashing and sink functions to avoid any unnecessary decrease in product reliability and any unnecessary increases in product costs.

SUMMARY OF THE INVENTION

This invention relates to a method for cleaning an in-sink dishwasher comprising a bowl having a bottom wall and a peripheral side wall forming a wash chamber, a basket received within the wash chamber for holding dishes to be washed, a sprayer carried by the basket for spraying liquid through out the wash chamber to clean the dishes, and a liquid supply for supplying liquid to the sprayer. The method comprises: uncoupling the liquid supply from the sprayer, spraying liquid against the peripheral side wall from the liquid supply, and draining the sprayed liquid from the wash chamber.

Preferably, the uncoupling of the liquid supply from the sprayer comprises removing the basket from the wash chamber. The spraying of liquid against the side wall preferably comprises laterally spraying the liquid from a nozzle located near the bottom wall. The cleaning method can also incorporate the recirculating of liquid to the liquid supply.

The spraying of liquid can comprise a wash step where liquid comprising a mixture of detergent and water is sprayed against the peripheral side wall. The spraying of liquid can also comprise a rinse step where a rinse liquid is sprayed against the peripheral side wall. Preferably, the rinse step follows the wash step. The rinse liquid is preferably water. The liquid can be heated.

In another embodiment, the invention relates to a method of cleaning an in-sink washer comprising a lid for covering the wash chamber. The method includes the step of detecting the closure of the lid before allowing the spraying of liquid.

DESCRIPTION OF THE PREFERRED EMBODIMENT

Figure 1:
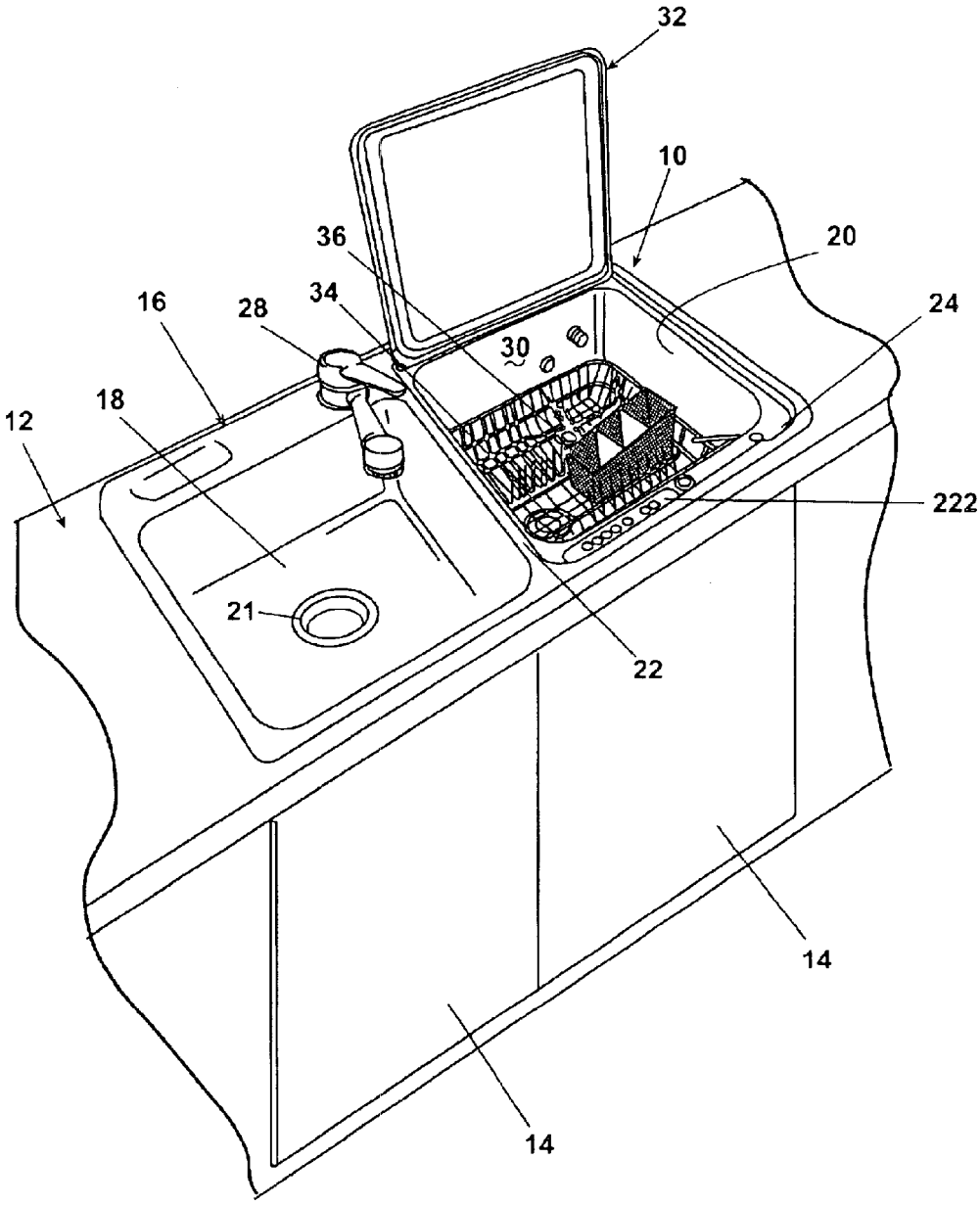
FIG. 1 is a perspective view of an in-sink dishwasher according to the invention, with the in-sink dishwasher shown mounted in a cabinet, the sink being of a double-bowl configuration and the one bowl forming part of the in-sink dishwasher having a lid, shown in an opened position, for covering the one bowl.

FIG. 1 illustrates an in-sink dishwasher 10 mounted in a traditional cabinet fixture 12 having doors 14 providing access to the cabinet interior where the lower portion of the in-sink dishwasher 10 is located.

The in-sink dishwasher 10 is illustrated in the environment of a double-bowl sink 16 comprising a first bowl 18 and a second bowl 20. The first bowl 18 performs the function of a traditional sink bowl and includes a drain opening 21. The second bowl 20 performs the dual function of a traditional sink bowl while also forming a portion of the housing for the in-sink dishwasher.

The first and second bowls 18, 20 are spaced from each other to define an intervening flange portion 22 that intersects a peripheral flange 24 surrounding both of the bowls 18, 20. Preferably, the double-bowl sink is made from stainless steel.

A traditional water faucet 28 is located in the peripheral flange 24 of the double-bowl sink and provides water to either of the first and second bowls 18, 20.

Figure 2:
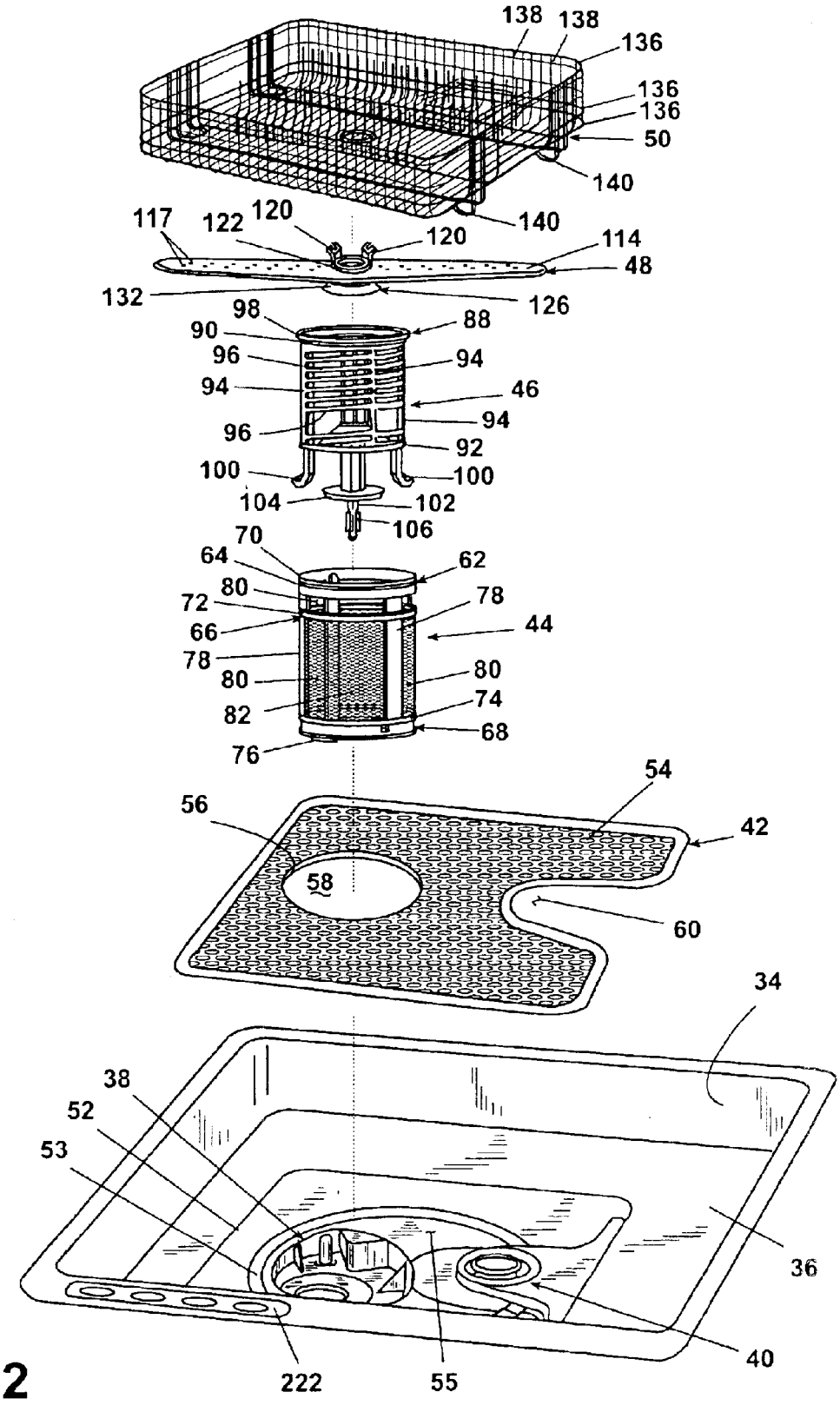
FIG. 2 is an assembly view of the in-sink dishwasher of FIG. 1 and illustrating the assembly of the major removable components of the in sink dishwasher which include the basket, spray arm, drain plug, drain filter, and bottom screen.

Referring to FIG. 2 specifically and FIG. 1 generally, the in-sink dishwasher 10 comprises a wash chamber 30 that is defined by the second bowl 20, which has an open top. A lid 32 is hingedly mounted to the peripheral flange 24 of the double-bowl sink 16 and is movable between opened and closed positions to cover the open top of the second bowl 18 as shown in FIG. 1.

The second bowl 20 is formed by a peripheral wall 34 and a bottom wall 36. The peripheral wall 34 extends upwardly and away from the bottom wall 36. A drain 38 is provided in the bottom wall 36. A self-aligning poppet valve 40 also is located in the bottom wall 36. Preferably, the self-aligning poppet valve 40 is centered in the bottom wall since the poppet valve 40 forms one part of a liquid coupling for supplying liquid to the wash chamber 30 when the second bowl 20 is used as an in-sink dishwasher.

Figure 3:
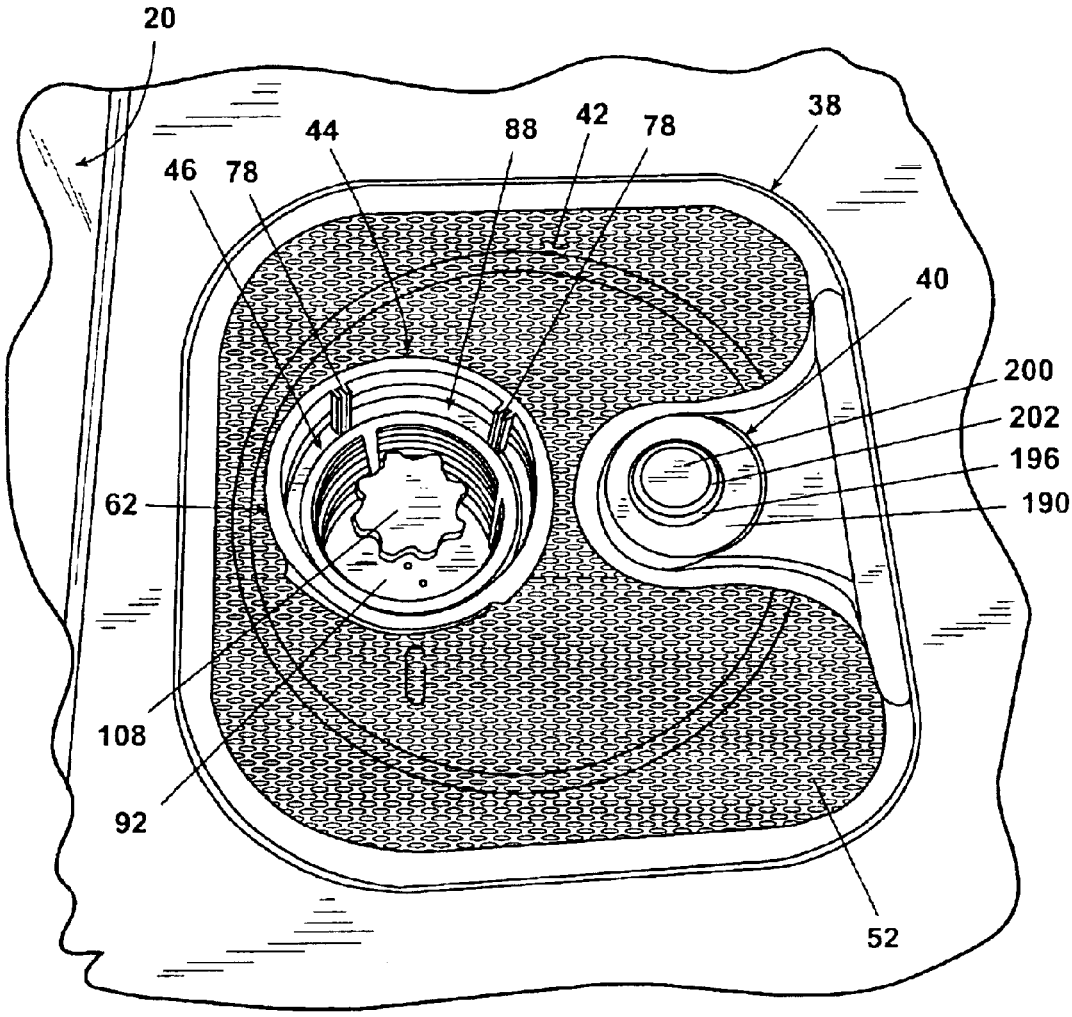
FIG. 3 is a top perspective view of the bottom of the sink of the assembled in-sink dishwasher and illustrating the liquid conduit including a poppet valve and its relationship to a sink drain, with the drain plug and drain filter received within the sink.
Figure 4:
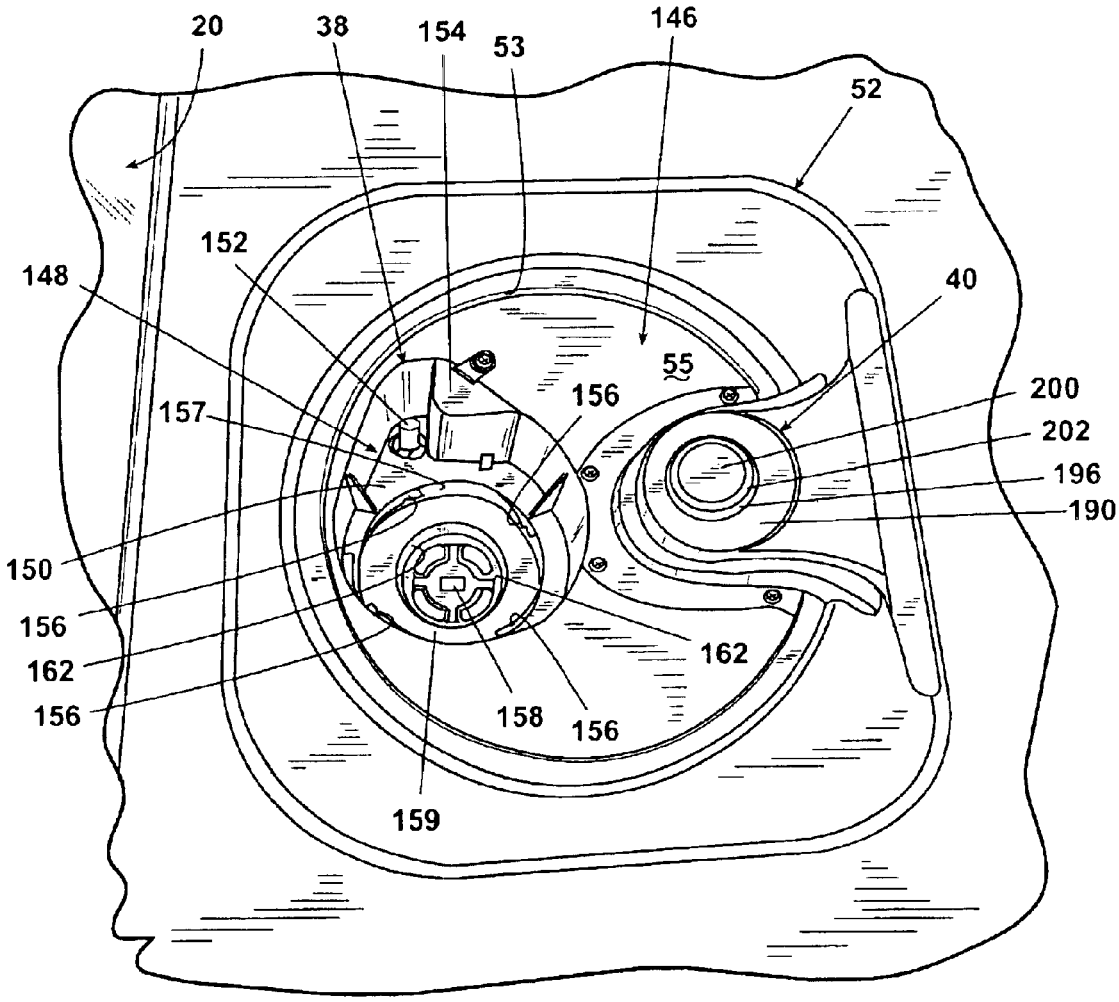
FIG. 4 is a top perspective view identical to FIG. 3 except that the drain plug, drain screen, and bottom screen are removed to better illustrate the sink drain and the temperature and pressure sensors located therein.

Referring to FIGS. 2–4, several removable components are provided for the in-sink dishwasher 10 and include a bottom screen 42, drain filter 44, drain plug 46, spray arm 48, and dish basket 50. The bottom screen 42 is preferably formed of a thin metal material, such as stainless steel, in which is formed a series of perforations or holes 54. A downwardly extending annular flange 56 is provided in the bottom screen 42 and defines a drain opening 58, which aligns with the drain 38 when the bottom screen 42 is mounted to the bottom wall 36. A recess 60 is formed on one side of the bottom screen 42 and is sized to receive the poppet valve 40 when the bottom screen 42 is positioned against the bottom wall 36.

As best seen in FIGS. 3 and 4, the bottom wall includes a well 52 having an annular flange 53. The shape of the well 52 corresponds to the shape of the bottom screen 42 thereby permitting the bottom screen 42 to nest within the well 52 to mount the bottom screen 42 to the bottom wall 36. The annular flange 53 defines an opening 55 in which the drain 38 and the poppet valve 40 are located.

When the bottom screen 42 is positioned within the well 52, the upper surface of the bottom screen 42 effectively performs the function of, and is in alignment with, the upper surface of the bottom wall 36 surrounding the bottom screen 42. In other words, the bottom screen 42 effectively forms a portion of the upper surface of the bottom wall 36 when the bottom screen 42 is used.

Referring to FIGS. 2–4, the drain filter 44 has a generally cylindrical shape with an open top and an open bottom. The drain filter 44 comprises a skeletal frame 62, preferably made from plastic, comprising top, middle, and bottom rings 64, 66, 68, each of which includes a corresponding shoulder 70, 72, 74. The bottom ring 68 includes locking lugs 76 forming part of a bayonet mount for securing the drain filter 44 within the drain 38. The rings 64, 66, 68 are connected by spaced rails 78 to thereby define a series of windows 80. A screen 82, preferably in the form of a fine wire mesh, is mounted to and is carried by the skeletal frame 62 such that the screen 82 overlies the windows 80 located between the middle and bottom rings 66, 68. The screen 82 functions as a filter for the drain 38.

The plug 46 also has a generally cylindrical shape with an open top and a closed bottom, with an outer periphery small enough to be received within the interior of the drain filter 44. The plug 46 comprises a skeletal frame 88, preferably made from plastic, and comprising a top annular ring 90 and a bottom wall 92, which are connected by rails 94. A series of intermediate annular ribs 96 are integrally formed with the rails 94.

As best seen in FIG. 3, when the drain filter 44 and plug 46 are received within the drain 38, the top ring 64 of the drain filter 44 is positioned above the bottom wall 36 and bottom screen 42 and the middle ring 66 is adjacent to or in contact with the bottom screen 42. The top ring 90 of the plug 46 is in contact with the middle ring 66 of the drain filter 44. Therefore, liquid can pass through the windows 80 between the top rings 64 and the middle ring 62 and flow into the interior of the plug 46, where the liquid will then pass through the skeletal frame 88 of the plug 46, through the screen 82 of the drain filter 44, and into the drain 38, to filter particulates from the liquid.

The top annular ring 90 also includes a shoulder 98. Multiple feet 100 extend downwardly from the bottom wall 92. A stopper support 102 extends downwardly from the bottom wall 92 and carries a stopper 104, preferably made from a suitable rubber or plastic. The stopper support 102 terminates in a key 106, which cooperates with the drain 38 to fix the position of the plug 46 in the drain 38. A knob 108 extends upwardly into the interior of the skeletal frame 88 from the bottom wall 92. The knob 108 aids in rotating the plug 46.

Figure 5:
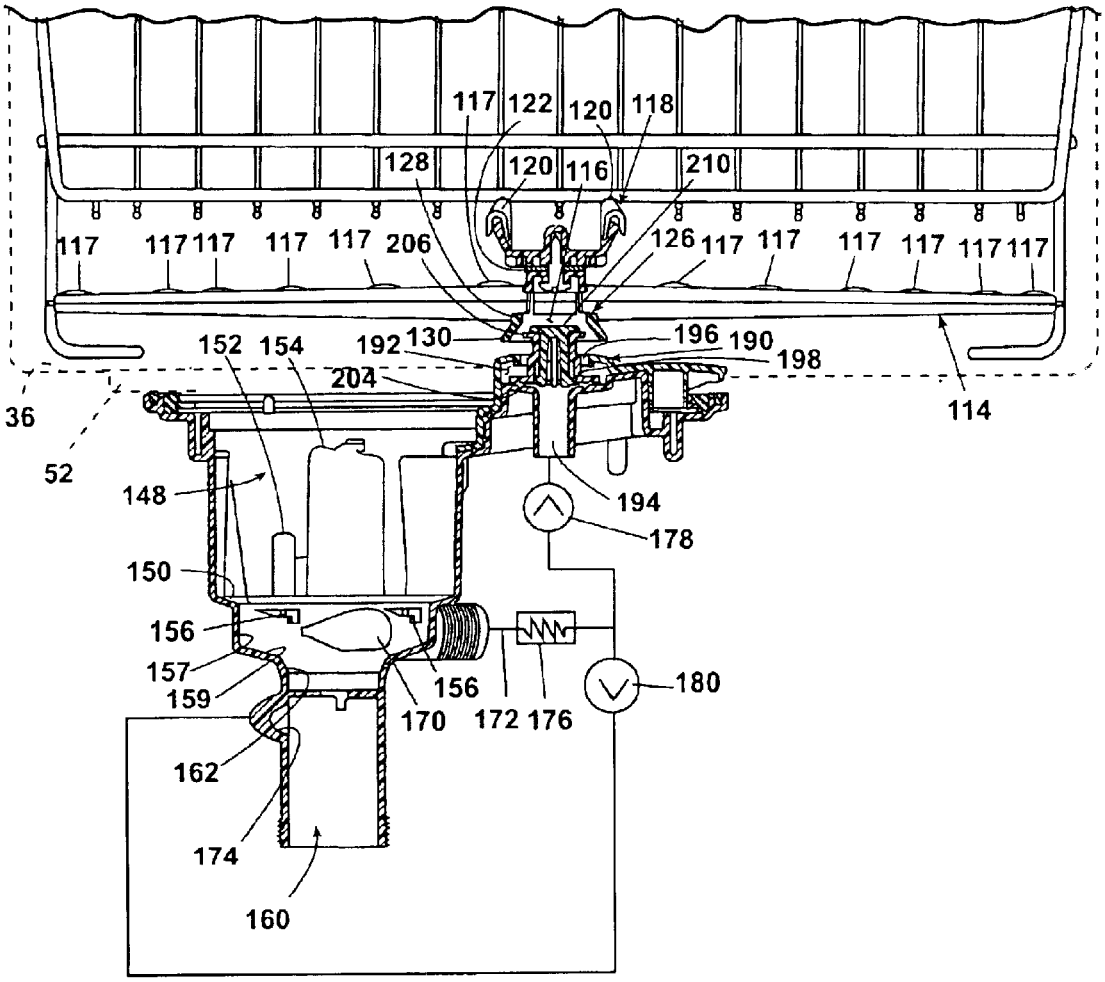
FIG. 5 is a side sectional view of the assembled basket, spray arm, poppet valve, and drain with the poppet valve shown in the closed position and the basket in an unseated position.

Referring to FIGS. 2 and 5, the spray arm assembly 48 comprises a hollow spray arm 114, preferably made from stainless steel, with a liquid inlet 116 formed in a lower surface and spray outlets 117 formed on an upper surface. A mounting bracket 118 is secured to the upper surface of the spray arm 114 and includes resilient hooks 120 for snap-fitting with the basket 50 and a rotatable coupling 122 that rotatably mounts the spray arm 114 to the resilient hooks 120. Thus, the mounting bracket 118 provides for the snap-fit mounting of the spray arm 114 to the basket along with permitting the spray arm 114 to rotate relative to the basket 50.

A deflector 126 is mounted to the lower surface of the spray arm 114 and circumscribes the liquid inlet 116. The deflector 126 comprises an annular collar 128 from which extends an angled surface 130, terminating in an annular lip 132. The annular collar 128 and angled surface 130 form a funnel-type structure leading to the liquid inlet 116. The diameter of the angled surface 130 is greater than the diameter of the liquid inlet 116. The deflector 126 forms part of a coupling that automatically aligns the liquid inlet 116 with the poppet valve 40.

Referring to FIGS. 2 and 5, the basket 50 is made from multiple coated wires in a well-known manner and will not be described in great detail. The basket includes multiple peripheral wires 136, forming the outer periphery of the basket side wall, and multiple U-shaped wires 138 laterally spanning the peripheral wires 136 to form the basic basket shape. Feet 140 are formed by wires extending from the side of the basket. The feet 140 are preferably L-shaped and extend below the bottom of the basket so that the bottom of the basket will be spaced from the bottom wall of the sink when the feet touch the bottom wall.

Referring to FIGS. 3–7, the drain 38 is shown in greater detail. The drain 38 is preferably made from plastic and includes a top wall 146 and in which is formed a sump 148. The top wall 146 mounts to the annular flange 53 of the sink bottom wall 36. An annular platform or shoulder 150 is formed within the interior of the sump 148 and provides a support on which are mounted a temperature sensor 152, preferably in the form of a thermistor, and a liquid level sensor 154, preferably in the form of a dome-type pressure sensor.

Spaced mounting lugs 156 extend radially inwardly from a side wall 157 of a reduced diameter portion of the sump 148, which terminates in a second shoulder 159. The lugs 156 are located axially beneath the shoulder 150. The mounting lugs 156 cooperate with the lugs 76 on the skeletal frame 62 of the filter 44 to permit the bayonet mounting of the filter 44 to the sump by rotation of the skeletal frame 62.

A key hole 158 is located in the center of a waste drain portion 160 of the sump 148 and below the lugs 156. An annular angled sealing surface 162 provides the transition from the second shoulder 159 to the waste drain 160. The key hole 158 cooperates with the key 106 on the end of the stopper support 102 of the plug 46 for securing the plug to the sump 148.

When the drain filter 44 is received within the sump 148 and secured by the interacting lugs 76 and 156, the shoulder 74 of the bottom ring 222 will bear against the platform 150 and/or the side wall 157 to effect a seal between the filter 44 and the sump 148. When the plug 46 is secured to sump 148 by the cooperation between the key 106 and the keyhole 158, the stopper 104 is compressed against the annular sealing surface 162 to close off the waste drain 160.

A recirculation inlet 170 is formed in the side wall 157 of the sump 148 below the lugs 156 and above the annular sealing surface 162. A recirculation inlet 170 is connected to the poppet valve 40 by a liquid conduit 172, which is shown schematically in FIGS. 5–7. The recirculation inlet 170 permits liquid flow in the sump 148 to be directed through the conduit 172 to the poppet valve 40 and into the spray arm 48, when the basket 50 is seated within the second bowl 20 to establish a recirculation loop where liquid can be continuously recirculated from the sump and onto the dishes contained in the basket 50.

The recirculation inlet 170 of the sump 148 is positioned above the annular sealing surface 162 so that when the stopper 104 of the plug 46 closes the waste drain 160, liquid can still be drawn into the recirculation loop through the recirculation inlet 170. The recirculated liquid will be drawn through the drain filter to ensure that particulates in the liquid are not recirculated back onto the dishes.

A recirculation drain 174 is fluidly connected to the waste drain 160 below the keyhole 158. The recirculation drain 174 is also fluidly connected to the conduit 172. The fluid connection of the recirculation drain 74 between the waste drain 160 and the liquid conduit 172 permits the draining of the liquid in the recirculation loop even when the drain plug 46 has closed off the waste drain 160.

Figure 6A:
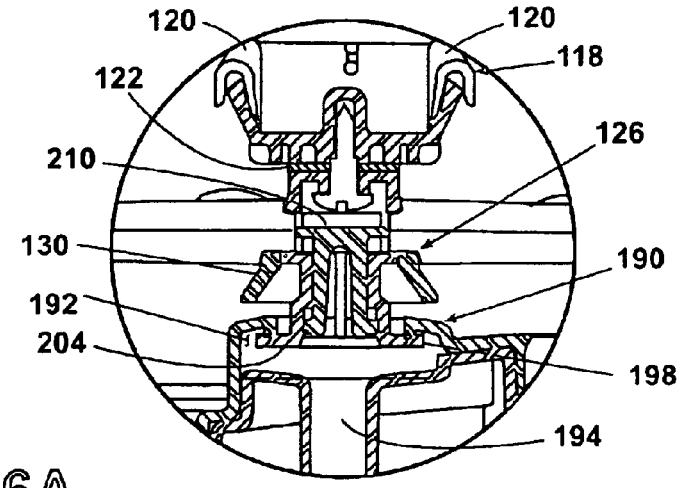
FIG. 6A is an enlarged view of the poppet shown in FIG. 6.
Figure 7A:
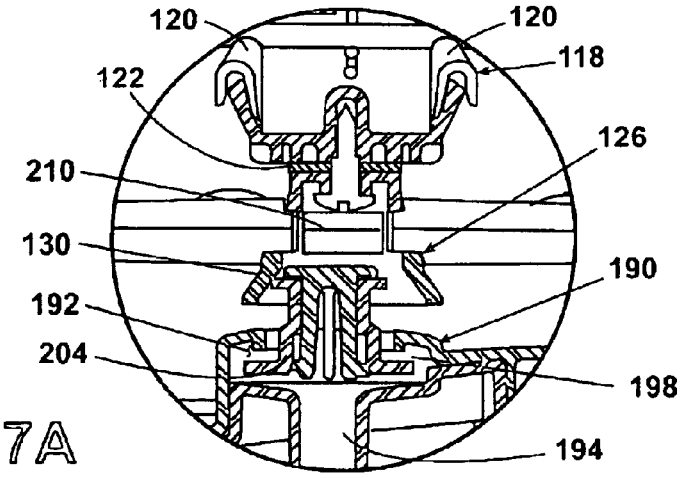
FIG. 7A is an enlarged view of the poppet shown in FIG. 7.
Figure 6:
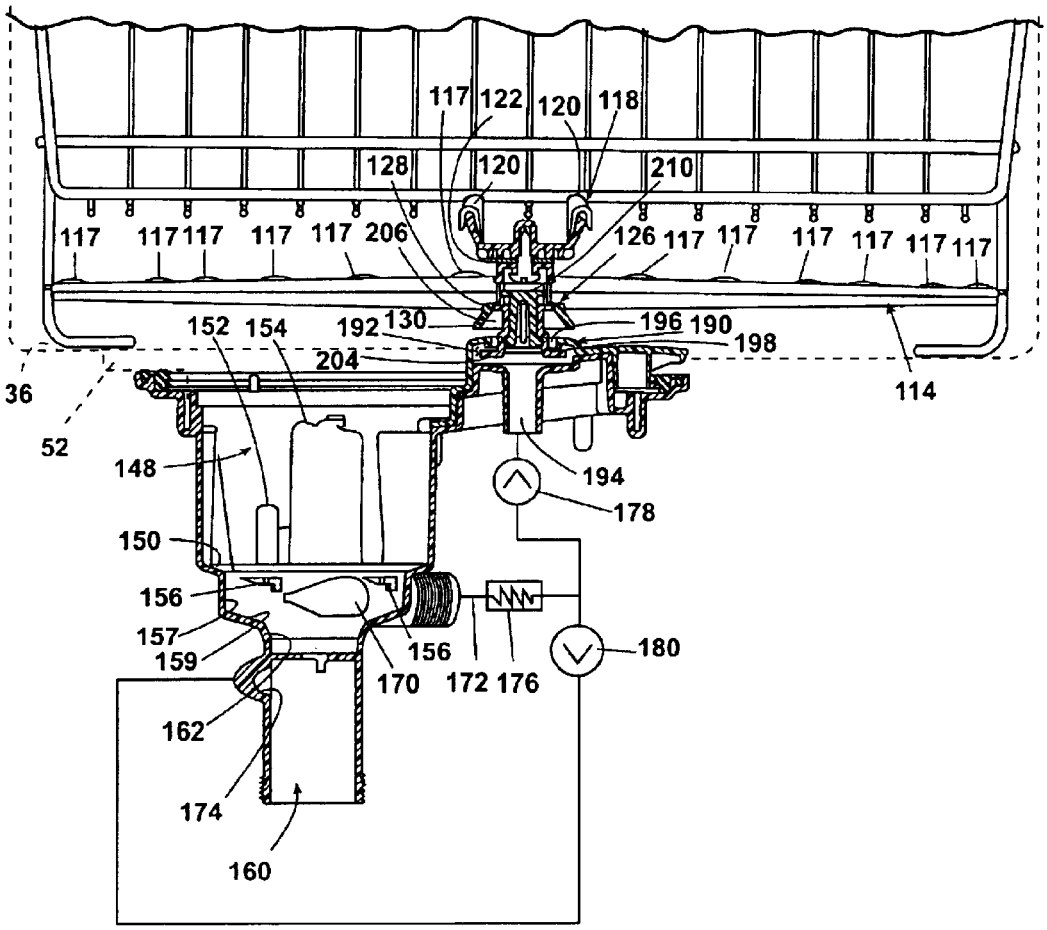
FIG. 6 is a side sectional view identical to FIG. 5 except that the poppet valve is opened and the basket is seated.
Figure 7:
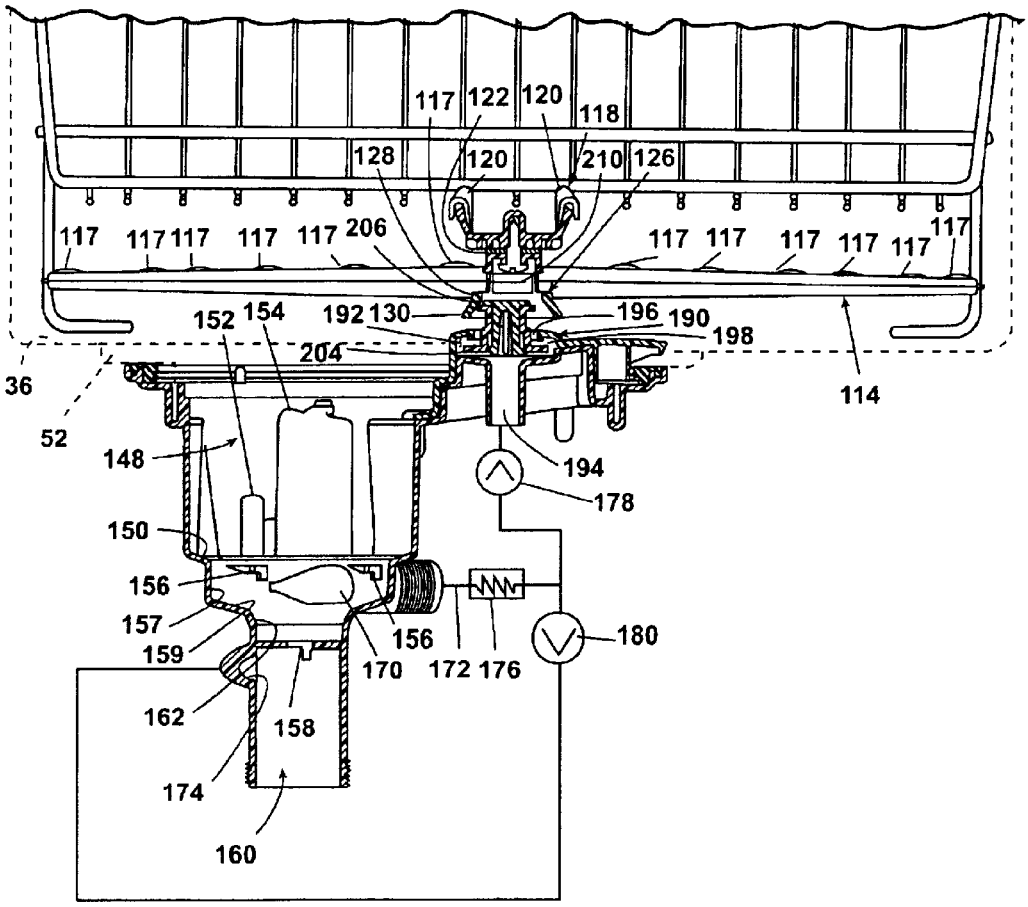
FIG. 7 is a side sectional view like FIG. 5 except that the poppet valve is not aligned with the spray arm and the basket is not seated in the wash chamber.
Figure 8:
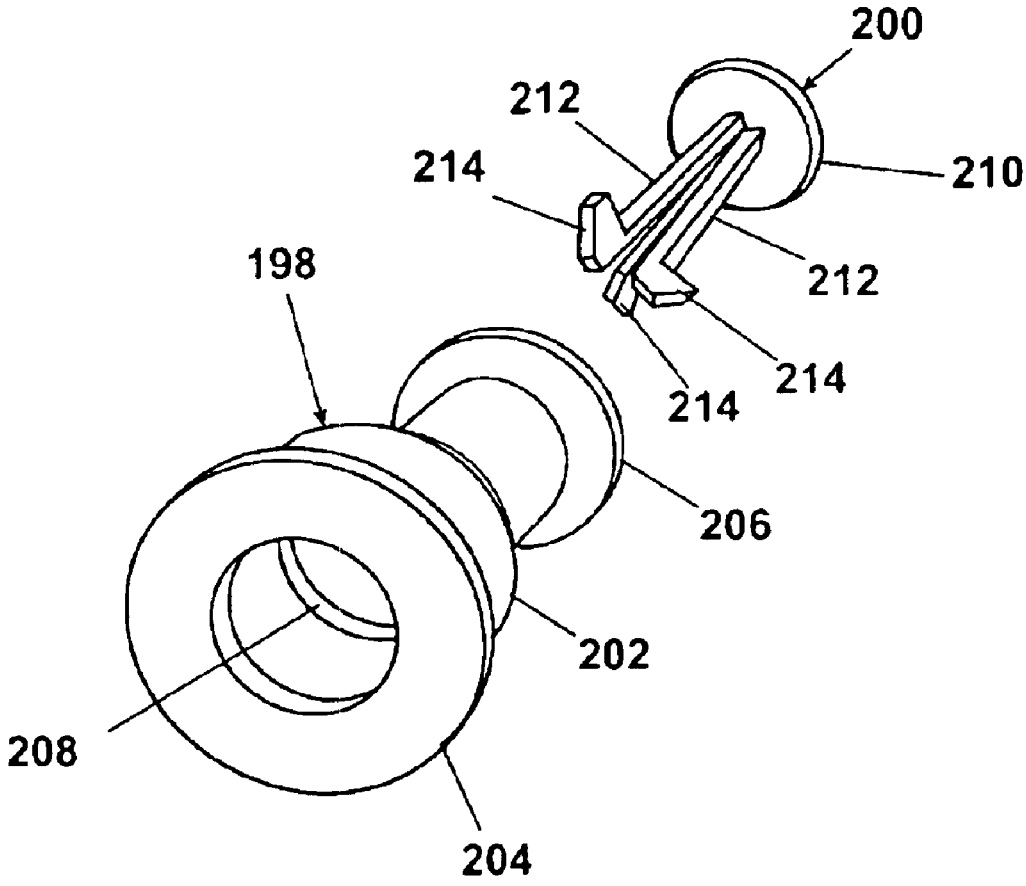
FIG. 8 is an assembly view of the poppet and feed tube shown in FIGS. 5–7.

Shown schematically in FIGS. 5–7, an in-line liquid heater 176 and a recirculation pump 178 are fluidly connected to the liquid conduit 172 and form part of the recirculation loop. The in-line water heater 176 is used to receive liquid passing through the conduit 172 and the recirculation pump 178 pumps liquid through the recirculation loop.

A drain pump 180 is also fluidly connected to the liquid conduit 172 as well as to the recirculation drain 174. The drain pump 180 permits the liquid in the recirculation loop to be drained from the wash chamber through the sump when the drain plug 46 has closed the waste drain 160.

The recirculation pump 178 and drain pump 180 act both as a valve and a pump since when the pumps are turned off, water cannot pass through the pump. Therefore, both pumps can be coupled to the liquid conduit 172 without interfering with the flow of liquid through the recirculation loop or the draining of liquid from the recirculation loop. It is possible for a single pump to be used in place of separate recirculation in drain pumps.

Referring to FIGS. 5–8, the poppet valve 40 is shown in greater detail. The poppet valve 40 comprises a housing 190 that is mounted to the top wall 146 and defines a chamber 192 therebetween that is fluidly connected to the liquid conduit 172 by an inlet 194 formed in the top wall 146. A liquid outlet opening 196 is formed in the housing 190. The chamber 192 can be thought of as essentially a continuation of the conduit 172 and the liquid outlet opening 196 can be thought of as an outlet for the liquid conduit 172.

A poppet assembly comprising a feed tube 198 and a poppet 200 extend from the poppet chamber 192 through the liquid outlet opening 196. The feed tube 198 comprises a nozzle 202 extending from a base 204. The nozzle 202 defines a hollow interior and has a proximal end that connects to the base 204 and a distal end that terminates in a radially extending annular rib 206. The interior of the nozzle comprises a shoulder 208 that functions as a stop for the poppet 200.

The poppet comprises cap 210 from which depend resilient legs 212, which terminates in radially extending feet 214. The resilient legs 212 are located along the cap 210 such that they can be received through the hollow interior of the nozzle 202. The feet 214 extend a sufficient radial distance so that they will bear against the shoulder 208 of the nozzle 202 to limit the axial movement of the poppet 200 relative to the nozzle 202. The resilient nature of the legs 212 permits the poppet 200 to be assembled to the nozzle 202 by deflecting the legs 212 radially inwardly until they can pass through the opening to the hollow interior of the nozzle defined by the annular rib 206. As the legs 212 are inserted into the hollow interior of the nozzle 202, they will spring radially outwardly once the feet 214 clear the shoulder 208.

The operation of the poppet valve 40 is dependent on whether or not there is pressurized liquid being directed through the liquid conduit 172. When there is no pressurized liquid acting on the poppet valve 40, the poppet valve is as it appears in FIGS. 5 and 5A. In such an unpressurized condition, the base 204 is spaced from the liquid outlet opening 196 of the housing 190 and rests on the top wall 146 circumscribing and enclosing the poppet chamber inlet 194. The cap 210 of the poppet 200 rests on the annular rib 206 of the nozzle 202 to close off the hollow interior of the nozzle 202.

When there is pressurized liquid acting on the poppet 40, the poppet valve 40 takes the position as illustrated in FIGS. 6 and 6A. In such a pressurized condition, the pressurized liquid forces the feed tube 198 upwardly until the base 204 contacts the housing 190 to seal the liquid outlet opening 196. The pressurized liquid must then pass through the hollow interior of the nozzle 202 where it contacts the cap 210 of the poppet to raise the cap above the annular rim 206 of the nozzle 212 and permits fluid flow through the nozzle 200 to and between the cap 210 and the annular rib 206.

In the pressurized condition, the cap 210 forms a spray head for the poppet valve 40 and forms outlet openings defined by the gaps between the cap 210, annular rib 206, and legs 212. Since the cap 210 and annular rib 206 are radially extending, the defined outlet openings are inherently laterally extending, resulting in any liquid passing through the poppet valve 40 to be directed laterally toward the peripheral wall 34 of the bowl 20. In other words, the axial flow of the pressurized liquid through the nozzle 202 is laterally deflected when it contacts the cap 210 to direct the pressurized liquid laterally toward the peripheral wall 34 of the bowl 20.

Figure 5A:
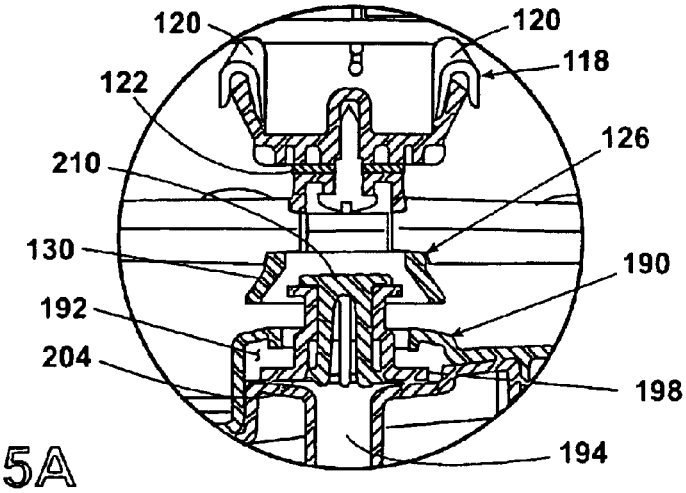
FIG. 5A is an enlarged view of the poppet shown in FIG. 5.

The seating of the basket 50 within the second bowl 20 and the corresponding alignment of the poppet valve 40 with the liquid inlet 116 of the spray arm 114 is best seen by comparing FIGS. 5–7A. FIGS. 5 and 5A illustrate the poppet valve 40 aligned with the liquid inlet 116 of the spray arm 114, but before the basket 50 is completely seated within the second bowl 20. For the preferred embodiment disclosed in the specification, the basket 50 is seated when the feet 140 of the basket 50 rest on the bottom wall 36 of the second bowl 20. FIG. 6 illustrates the poppet valve 40 aligned with the liquid inlet 116 of the spray arm 114 when the basket 50 is seated in the second bowl 20.

The seating of the basket 50 and the alignment of the liquid inlet 116 with the poppet valve 40 will correspond to FIGS. 5–6A when the nozzle 202 is axially aligned with the liquid inlet 116 as the basket 50 is inserted into the second bowl 20 and the axial alignment is maintained through the seating of the basket 50 in the second bowl 20. In such a seated and aligned condition, when pressurized liquid flows through the liquid conduit 172, the cap 210 of the poppet 200 will lie substantially at the midpoint of the hollow interior of the spray arm 114 as shown in FIGS. 6 and 6A. In such a position, the pressurized liquid exiting the nozzle 202 is directed laterally by the cap 210 of the poppet 200 and will naturally flow laterally and fill the hollow interior of the spray arm 114 where the liquid exits the spray openings 117 to spray the dishes retained in the basket above.

It is anticipated that the user will not ensure that the nozzle 202 and the poppet 40 are manually aligned with the liquid inlet 116 of the spray arm 114 when the user seats the basket 50 within the second bowl 20, especially since the outer periphery of the basket 50 is smaller than the area defined by the peripheral wall 34. The difference in the dimensions between the outer periphery of the basket 50 and the area defined by the peripheral wall 34 results in some "play" between the basket 50 and the peripheral wall 34. The play between the basket 50 and the peripheral wall 34 can be quantified as the range of movement of the basket within the bowl 20 assuming nothing other than contact between the basket 50 and the peripheral wall 34 limits their relative movement.

The play between the basket 50 and the peripheral wall 34 can result in the misalignment of the nozzle 202 with the liquid inlet 116 when the basket is being seated unless some action is taken to keep or force the alignment. The nozzle 202, in combination with the deflector 126, forms a self-aligning coupling for fluidly coupling the liquid conduit 172 to the liquid inlet 116. The angled surface 130 of the deflector 126 will contact the annular rib 206 of the nozzle 202 when the nozzle 202 is not axially aligned with the liquid inlet 116 as the basket 50 is being seated. Such a condition is shown in FIG. 7.

Once the angled surface 130 contacts the annular rib 206, further insertion by the user of the basket 50 to complete the seating of the basket 50 within the second bowl 20 moves the nozzle 202 laterally relative to the second bowl peripheral wall 34 and into alignment with the liquid inlet 116. The nozzle 202 is free to laterally move until the nozzle 202 contacts the liquid outlet opening 196. To ensure that the nozzle 202 can laterally move a sufficient distance to align the nozzle 202 with the liquid inlet 116, the range of lateral movement of the nozzle 202 and the liquid outlet opening 196 is preferably greater than the range of lateral movement of the basket 50 relative to the second bowl 20.

The deflector 126 can reduce or eliminate the need for the range of motion of the nozzle 202 relative to the liquid outlet opening 196 to be greater than the range of motion of the basket 50 relative to the peripheral wall 34 of the second bowl 20. With the deflector 126, alignment between the nozzle 202 and the liquid inlet 116 can be ensured as long as the deflector is sized such that the greatest diameter of the angled surface 130 will make contact with the nozzle 202.

It is preferred that the greatest diameter of the angled surface 130 is sized such that the nozzle 202 always lies entirely within the deflector 126 for the entire range of movement of the basket 50 relative to the peripheral wall 34 of the second bowl 20. It should be noted that the invention will still work if for some reason the entire nozzle 202 does not lie within the deflector 126. Under such circumstances, contact between the nozzle 202 and the deflector 126 will provided the user with tactile feedback in positioning the nozzle 202 within the deflector 126.

Figure 9:
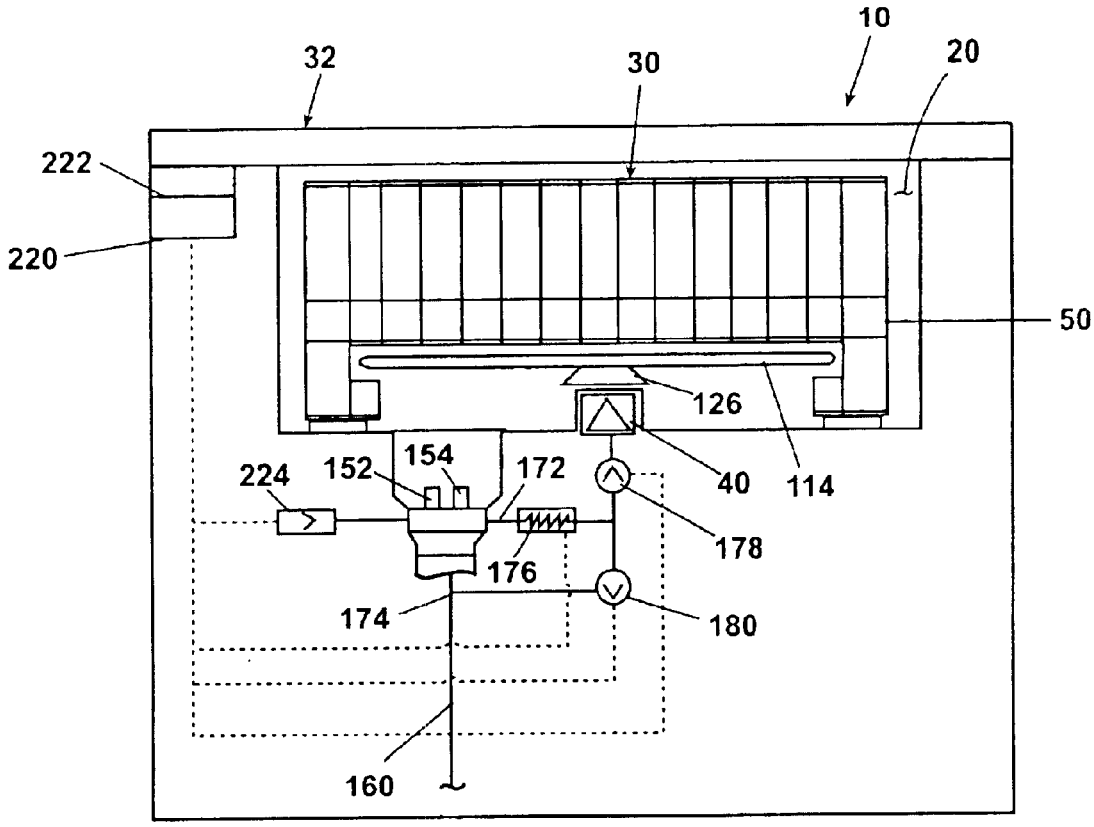
FIG. 9 is a schematic illustration of the major components of the in-sink dishwasher and their functional interaction.

FIG. 9 schematically illustrates a controller 220, preferably a microprocessor-based controller, used to control the operation of the in-sink dishwasher and the electrical coupling of the controller to the in-line heater 176, recirculation pump 178, drain pump 180, inlet valve 224, liquid level sensor 154, and temperature sensor 152 to control their respective operations.

The controller 200 controls the operation of a wash cycle and preferably has multiple pre-programmed wash cycles stored within the memory of the controller. There are many well-known wash cycles such as Regular Wash, High Temperature or Sanitizing Wash, China Wash, Wash with Pre-Soak, and Pots and Pans Wash, to name a few. The wash cycles typically comprise multiple steps, the building blocks of which include introducing and recirculating a charge of water into the wash chamber. Some steps can include the addition of a detergent. Other steps might include heating the water. The exact cycles and steps are not germane to the current invention other than the controller 200 for the in-sink dish washer is capable of performing one or more wash cycles.

To perform a wash cycle, the controller 200 operates the in-line heater 176, recirculation pump 178, drain pump 180, and inlet valve 224, along with data from the water level sensor 154 and the temperature sensor 152. The controller generally includes an internal clock that handles timing functions and internal counters for any cycle functions.

A user interface 222 is located adjacent the second bowl 20 and is electronically coupled to the controller 200. The user interface 222 permits the user to select the desired wash cycle from the multiple wash cycles stored in the memory of the controller 200 and enter any necessary or optional operating data or parameters for the wash cycles. The user interface preferably includes one or more visual or audible indicators used to display information to the user. For example, lights, preferably light-emitting diodes ("LEDs"), can be illuminated adjacent descriptive text or symbol on the user interface to indicate an associated status. A common use of the visual or audible indicators is to signal an error in the wash cycle, or the completion of one or more steps in the wash cycle or the entire wash cycle.

All of the wash cycles traditionally used in an automatic dishwasher or an in-sink dishwasher require the recirculation of liquid, with or without detergent, through the wash chamber to perform one step of the wash cycle. For example, during a rinse step of the overall cycle, water is introduced into the wash chamber and subsequently recirculated for a predetermined time. During a wash step, detergent is mixed with the water introduced into the wash chamber. The recirculation of the water with the detergent forms a wash liquid that is then recirculated through the wash chamber to clean the additions. To effect such a recirculation of liquid, the controller 220 ensures that the drain pump 180 is shut off, which prevents liquid from leaving the liquid conduit 172 and draining through the recirculation drain 174. The controller 220 energizes the recirculation pump 178 to recirculate the liquid from the sump 148, through the spray arm 114, onto the dishes in the basket 50, and the liquid subsequently flows back into the sump 148 where it is recirculated.

To drain the liquid from the wash chamber when the sink is operated as an in-sink dishwasher 10, meaning that the plug 46 is in place and closing the waste drain 160, the controller 220 ensures that the recirculation pump 178 is turned off to prevent the recirculation of the liquid within the liquid conduit 172. The controller 220 energizes the drain pump 180 which pumps the liquid from the sump 148 through the liquid conduit 172 and into the recirculation drain 174, which flows into the waste drain 160 to thereby drain the liquid from the sump.

If the liquid must be heated for a particular step of the wash cycle, the controller 220 will energize the in-line water heater 176 and heat the liquid passing therethrough.

One advantageous benefit of the in-sink dishwasher 10 is that the poppet valve 40 can be used to provide a self-cleaning function for the bowl 20. To accomplish this function, the user merely removes the basket 50 from the second bowl 20. The user then selects the self-cleaning function from the user interface 222. The controller 200 will introduce water into the wash chamber by opening the inlet valve 224 and recirculate the liquid as previously described. Since the combination of the poppet 200 and nozzle 202 results in the recirculated liquid being directed laterally toward the peripheral wall 34, the recirculated liquid will impact the peripheral wall and naturally clean the peripheral wall and flush any particles from the sink and into the sump 148. Once the recirculation of the liquid is completed, the controller 200 will drain the liquid from the sump as previously described.

The self-cleaning sink cycle can include additional steps. For example, it is possible to heat the recirculated liquid to better remove encrusted particles on the peripheral wall 34 or bottom wall 36. The self-cleaning sink cycle can include multiple sequences of a recirculation step followed by a drain step as previously described. The recirculation step could include the addition of detergent.

The self-cleaning sink cycle can be limited to operation only when the lid is closed. Under such circumstances, the controller can be linked to a latch securing the lid in the closed position to provide feedback to the controller that the lid is closed. The implementation of a lid-close sensor and data feedback to a controller is well known in the art and will not be described in detail.

While the invention has been specifically described in connection with certain specific embodiments thereof, it is to be understood that this is by way of illustration and not of limitation, and the scope of the appended claims should be construed as broadly as the prior art will permit.

We claim:

1. A method for cleaning an in-sink dishwasher comprising a bowl having a bottom wall and a peripheral side wall forming a wash chamber, a basket received within the wash chamber for holding dishes to be washed, a sprayer carried by the basket for spraying liquid through out the wash chamber to clean the dishes, and a liquid supply for supplying liquid to the sprayer, the method comprising:

uncoupling the liquid supply from the sprayer;

spraying liquid against the peripheral side wall from the liquid supply; and draining the sprayed liquid from the wash chamber.

2. The method according to claim 1, wherein the step of uncoupling the liquid supply from the sprayer comprises removing the basket from the wash chamber.

3. The method according to claim 2, wherein the step of spraying liquid against the side wall comprises laterally spraying the liquid from a nozzle located near the bottom wall.

4. The method according to claim 1, further comprising a wash step where liquid comprising a mixture of detergent and water is sprayed against the peripheral side wall.

5. The method according to claim 1, further comprising a rinse step of spraying a rinse liquid against the peripheral side wall.

6. The method according to claim 5, wherein the rinse liquid is water.

7. The method according to claim 5, further comprising the step of heating of the liquid.

8. A method for cleaning an in-sink washer, the method comprising the steps of:

providing a bowl forming a wash chamber;

providing a sprayer, carried by a basket received within the wash chamber, for spraying liquid through out the wash chamber;

providing a liquid supply for supplying liquid to the sprayer;

uncoupling the liquid supply from the sprayer;

spraying liquid throughout the wash chamber from the liquid supply; and draining the sprayed liquid from the wash chamber.

9. The method according to claim 8, wherein the step of uncoupling of the liquid supply from the sprayer comprises removing the basket from the wash chamber.

10. The method according to claim 8, further comprising a wash step where liquid comprising a mixture of detergent and water is sprayed against a peripheral side wall of the wash chamber.

11. The method according to claim 8, further comprising a rinse step of spraying a rinse liquid against a peripheral side wall of the wash chamber.

12. The method according to claim 8, further comprising the step of providing a lid for covering the wash chamber.

13. The method according to claim 12, further comprising the step of detecting a closure of the lid before allowing the spraying of liquid.

* * * * *